US005697762A

United States Patent [19]

Thompson et al.

[11] Patent Number: 5,697,762

[45] Date of Patent: Dec. 16, 1997

[54] GARMENT STACKER

[75] Inventors: Ken J. Thompson, Lexington; John R. Everhart; Wayne G. Foster, both of Winston-Salem; Joel C. Rosenquist, Kernersville, all of N.C.

[73] Assignee: Sara Lee Corporation, Winston-Salem, N.C.

[21] Appl. No.: 505,823

[22] Filed: Jul. 21, 1995

[51] Int. Cl.[6] ..... B65H 31/10

[52] U.S. Cl. ..... 414/792.9; 112/470.36; 414/793; 414/907

[58] Field of Search ..... 112/470.36; 414/907, 414/792.8, 793, 792.9

[56] References Cited

U.S. PATENT DOCUMENTS

| | | | |
|---|---|---|---|
| 3,126,657 | 3/1964 | Hajos | 414/907 |
| 3,661,384 | 5/1972 | Morton | 414/907 |
| 3,876,083 | 4/1975 | Evans et al. | 414/907 |
| 4,506,874 | 3/1985 | Preisig | 414/907 |
| 4,649,840 | 3/1987 | Keeton | 414/792.7 |

*Primary Examiner*—Karen B. Merritt
*Assistant Examiner*—Gregory A. Morse
*Attorney, Agent, or Firm*—Rhodes Coats & Bennett, L.L.P.

[57] ABSTRACT

A garment stacker for stacking garments in a garment stack. The apparatus includes a stacking tray having a support tray for supporting garments placed thereon in a garment stack and a tray actuator for adjusting the position of the support tray. A rotary stacker is positioned adjacent the stacking tray, wherein the rotary stacker repeatedly moves between a loading and an unloading position to successively stack garments on the stacking tray in a garment stack. A controller directs the tray actuator to position the support tray upwards when the rotary stacker is in the unloading position so as to press the garment stack between the stacking tray and rotary stacker. An unloader moves the garment stack from the stacking tray after a garment stack has been formed thereon.

40 Claims, 8 Drawing Sheets

GARMENT STACKER

BACKGROUND OF THE INVENTION (1) Field of the Invention

The present invention relates generally to automated manufacturing systems and, more particularly, to an apparatus for automatically stacking a sleeve or pant leg for a sweat suit or the like.

(2) Description of the Prior Art

The manufacture of textile clothing articles such as sweat suits and outer garments has resisted automation. This is due largely because of the difficulty in accurately handling so called "soft" materials. For example, the fleece material commonly used in sweat suits may wrinkle, stick to one another and stretch significantly when handled.

Even where automation has begun to make in-roads, other difficulties remain. For example, after the sleeves and pant legs are sewn, they must be stacked and bundled for transfer to the next sewing operation. This has always been a manual operation because of the dexterity required to locate the sewn fabric piece and properly stack it. Unfortunately, repetitive actions such as stacking garments may cause health problems. However, it has been extremely difficult to design a device which can reliably stack garment pieces such as sleeves or pant legs time after time.

Thus, there remains a need for an apparatus for automatically stacking a sleeve or pant leg for a sweat suit or the like which will operate reliably time after time while, at the same time, it can be carried out completely automatically without the need for a skilled operator.

SUMMARY OF THE INVENTION

The present invention is directed to a garment stacker for stacking garments in a garment stack. The apparatus includes a stacking tray having a support tray for supporting garments placed thereon in a garment stack and a tray actuator for adjusting the position of the support tray. A rotary stacker is positioned adjacent the stacking tray, wherein the rotary stacker repeatedly moves between a loading and an unloading position to successively stack garments on the stacking tray in a garment stack.

In the preferred embodiment, the rotary stacker includes a garment support for supporting a garment thereon and a rotary actuator for rotating the garment support between the loading and unloading positions.

A controller directs the tray actuator to position the support tray upwards when the rotary stacker is in the unloading position so as to press the garment stack between the stacking tray and rotary stacker.

An unloader moves the garment stack from the stacking tray after a garment stack has been formed thereon.

Accordingly, one aspect of the present invention is to provide a garment stacker for stacking garments in a garment stack. The apparatus includes: (a) a stacking tray having a support tray for supporting garments placed thereon in a garment stack and a tray actuator for adjusting the position of the support tray; (b) a rotary stacker positioned adjacent the stacking tray, wherein the rotary stacker repeatedly moves between a loading and an unloading position to successively stack garments on the stacking tray in a garment stack; and (c) a controller for directing the tray actuator to position the support tray upwards when the rotary stacker is in the unloading position so as to press the garment stack between the stacking tray and rotary stacker.

Another aspect of the present invention is to provide a rotary stacker for a garment stacker having a stacking tray for supporting garments placed thereon in a garment stack. The apparatus includes: (a) a garment support for supporting a garment thereon; and (b) a rotary actuator for rotating the garment support between a loading position where the garment is placeable on and supportable by the garment support and an unloading position where the garment support and supported garment are positioned over the stacking tray, wherein the rotary stacker repeatedly moves between the loading and unloading positions to successively stack garments on the stacking tray in a garment stack.

Still another aspect of the present invention is to provide a garment stacker for stacking garments in a garment stack. The apparatus includes: (a) a stacking tray having a support tray for supporting garments placed thereon in a garment stack and a tray actuator for adjusting the position of the support tray; (b) a rotary stacker positioned adjacent the stacking tray, wherein the rotary stacker repeatedly moves between a loading and an unloading position to successively stack garments on the stacking tray in a garment stack, the rotary stacker includes: (i) a garment support for supporting a garment thereon; and (ii) a rotary actuator for rotating the garment support between the loading and unloading positions; (c) a controller for directing the tray actuator to position the support tray upwards when the rotary stacker is in the unloading position so as to press the garment stack between the stacking tray and rotary stacker; and (d) an unloader for moving the garment stack from the stacking tray after a garment stack has been formed thereon.

These and other aspects of the present invention will become apparent to those skilled in the art after a reading of the following description of the preferred embodiment when considered with the drawings.

BRIEF DESCRIPTION OF THE INVENTION

DESCRIPTION OF THE PREFERRED EMBODIMENTS

Figure 1:
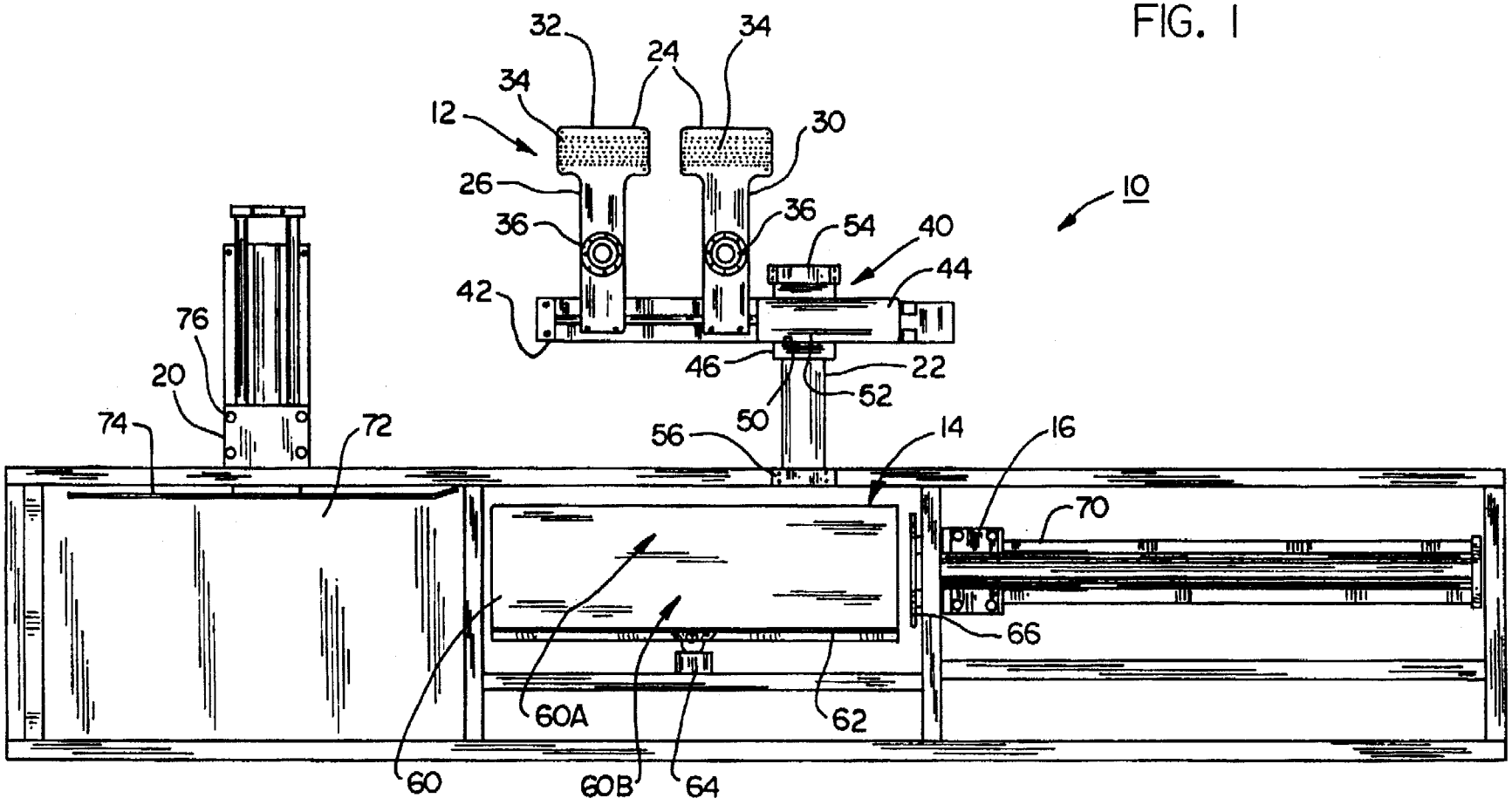
FIG. 1 is a plan view of a garment stacker constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 2:
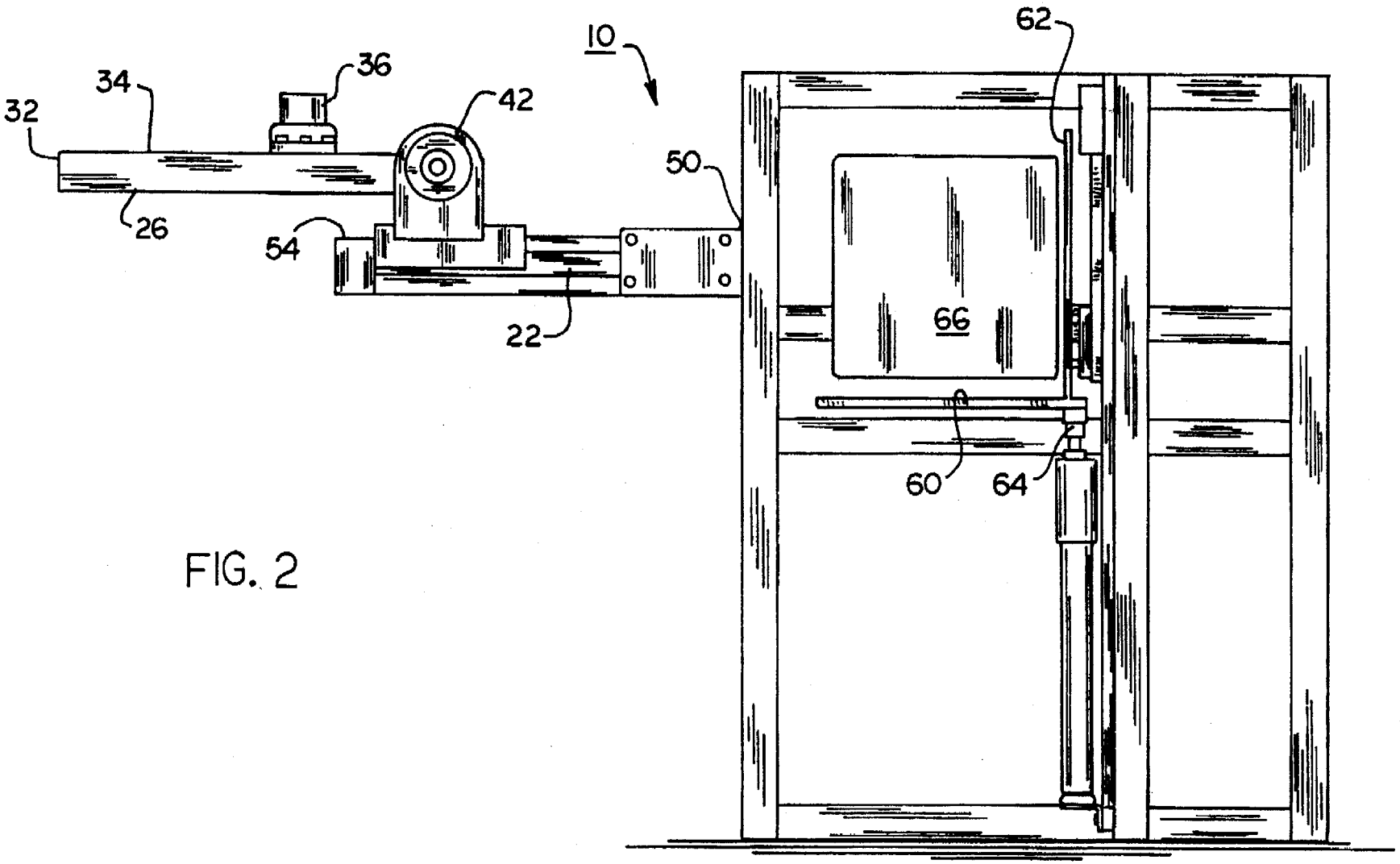
FIG. 2 is a side elevation view of the rotary stacker and first unloader shown in FIG. 1.

Referring now to the drawings in general and FIG. 1 and 2 in particular, it will be understood that the illustrations are for the purpose of describing a preferred embodiment of the invention and are not intended to limit the invention thereto. As best seen in FIGS. 1 and 2, a garment stacker, generally designated 10, is shown constructed according to the present invention. Garment stacker 10 is used to stack a plurality of garments and includes a rotary stacker 12, a stacking tray 14 and first and second unloaders 16 and 20.

Rotary stacker 12 supports a garment placed thereon and rotates to place the supported garment onto stacking tray 14. Rotary stacker 12 successively places garments on stacking tray 14 until a pre-determined number of garments have been stacked. First and second unloaders 16 and 20 function to remove garment stacks from stacking tray 14 and to remove the stacks from the garment stacker 10.

Figure 3:
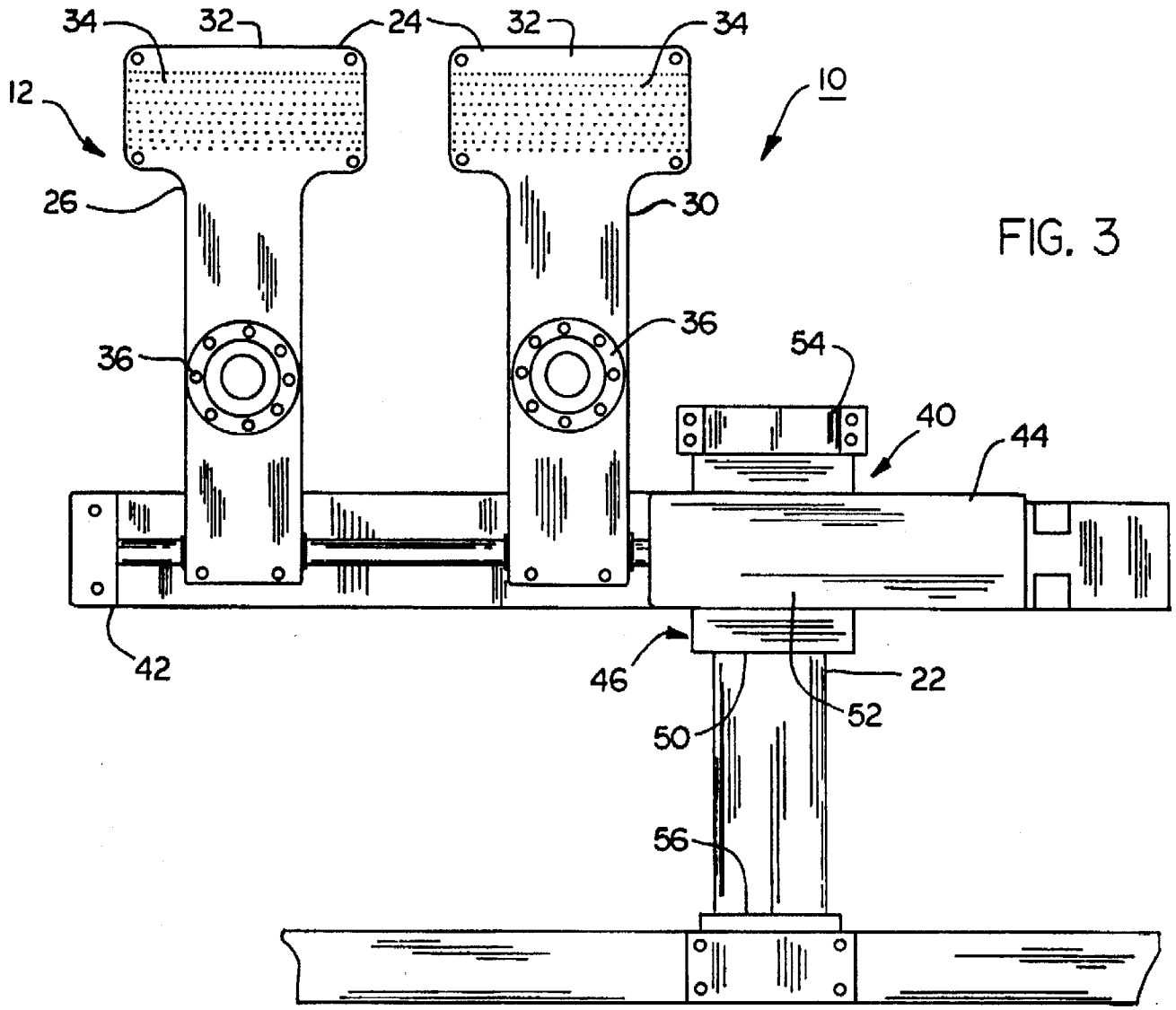
FIG. 3 is an enlarged plan view of the rotary stacker shown in FIG. 1 and 2.

As best shown by FIG. 3, rotary stacker 12 includes a garment support 24 supported by frame 22. Garment support 24 includes a pair of garment support arms 26 and 30 that each have a garment support surface 32. Garment support surfaces 32 provide surfaces over which a garment can be placed and supported. Vacuum openings 34 are formed in the support surfaces 32 and are connected to vacuum actuators 36. Vacuum actuators 36 selectively create a vacuum at vacuum openings 34. The vacuum created on the support surface 32 of garment support 24 is used to selectively grip garments that are to be transferred to stacking tray 14 by the rotary stacker 12.

A rotary actuator assembly 40 is connected to garment support 24 to rotate garment support 24 in order to position a gripped garment onto the stacking tray 14. Rotary actuator assembly 40 includes a rotary arm 42 connected to garment support arms 26 and 30, and a rotary motor 44 for rotating rotary arm 42 and attached garment support arms 26 and 30. In the preferred embodiment, rotary motor 44 is a servomotor. Rotary actuator rotates garment support arms 26 and 30 to position garment support arms 26 and 30 between a loading position and an unloading position that are 180° apart. When in the loading position, the support surfaces 32 of garment support arms 26 and 30 are generally in an upright, horizontal position where garments can be laid thereon. Rotary actuator 40 rotates the garment support arms 26 and 30 such that support surfaces 32 are rotated from an upright, horizontal position to a generally downright, horizontal position.

Rotary stacker 12 also includes a slide assembly 46 for positioning rotary arm 42 of rotary stacker 12. The placement of garments on stacking tray 14 can be controlled by adjusting the position of rotary arm which is the pivot axis for garment support arms 26 and 30. As best shown in FIG. 3, slide assembly 46 includes a carriage 50 onto which rotary arm 42 is mounted and a slide actuator 52 which is integrally a part of slide assembly 46. Slide actuator 52 positions carriage 50 along frame 22 and between stops 54 and 56. In the preferred embodiment, slide actuator 52 is a pneumatic rodless actuator.

Slide assembly 46 selectively varies the distance of the pivot axis of garment support arms 26 and 30 by moving rotary arm 42 and garment support arms 26 and 30 between retracted, partially-extended and fully-extended positions. When rotary arm 42 is in the retracted position, carriage 50 of slide assembly 46 is positioned adjacent first stop 54 and garment support arms 26 and 30 are positioned farthest from stacking tray 14. Slide actuator 52 positions carriage 50 approximately mid-way between first and second stops 54, 56 to place rotary arm 42 in the partially-extended position. When the rotary arm 42 is in the partially-extended position, garment support arms 26 and 30 are positioned such that the support surfaces 32 of support arms 26 and 30 are rotatable to a position adjacent a forward portion of the stacking tray 14. Slide actuator 52 positions carriage 50 adjacent second stop 56 to place garment support arms 26 and 30 in the fully-extended position. When the rotary arm 42 is in the fully-extended position, garment support arms 26 and 30 are positioned such that the support surfaces 32 of support arms 26 and 30 are rotatable to a position overlying a rear portion of the stacking tray. As will be described in more detail below, adjusting the position of rotary arm 42 allows a plurality of stacks to be formed on stacking tray 14.

Stacking tray 14 includes a bottom 60 on which garments are placed by rotary stacker 12. Bottom tray 60 has a forward section 60A for supporting a front garment stack and a rear section 60B for supporting a rear garment stack. A back surface 62 extends upwardly from bottom tray 60 and provides lateral support for the garments placed on bottom tray 60.

Stacking tray 14 further includes a tray actuator 64 for vertically adjusting bottom tray 60. Bottom tray 60 of stacking tray 14 is selectively raised and lowered by tray actuator 64 during the garment stacking process, as will be discussed below.

Turning back to FIG. 1, first unloader 16 is positioned adjacent stacking tray 14 and removes garment stacks from stacking tray 14. First unloader 16 includes an upright plate 66 disposed perpendicularly to bottom tray 60 and a plate actuator 70. Plate actuator 70 of first unloader 16 moves upright plate 66 between a retracted position and an extended position. When in the retracted position, upright plate 66 of first unloader 16 is positioned adjacent bottom tray 60. Plate actuator 70 moves the upright plate 66 from the retracted position to the extended position such that upright plate 66 travels over bottom tray 60 to push stacked garments from bottom tray 60.

A bin 72 is positioned adjacent bottom tray 60 of stacking tray 14 and receives stacked garments unloaded from stacking tray 14. Positioned adjacent bin 72 is a second unloader 20. Second unloader 20 includes an upright plate 74 that is connected to a plate actuator 76. Plate actuator 76 moves upright plate 74 from a retracted position to an extended position such that upright plate 74 travels over bin 72 to push garment stacks on bin 72 onto a waiting conveyor (not shown) or other transport device (not shown).

Figure 4:
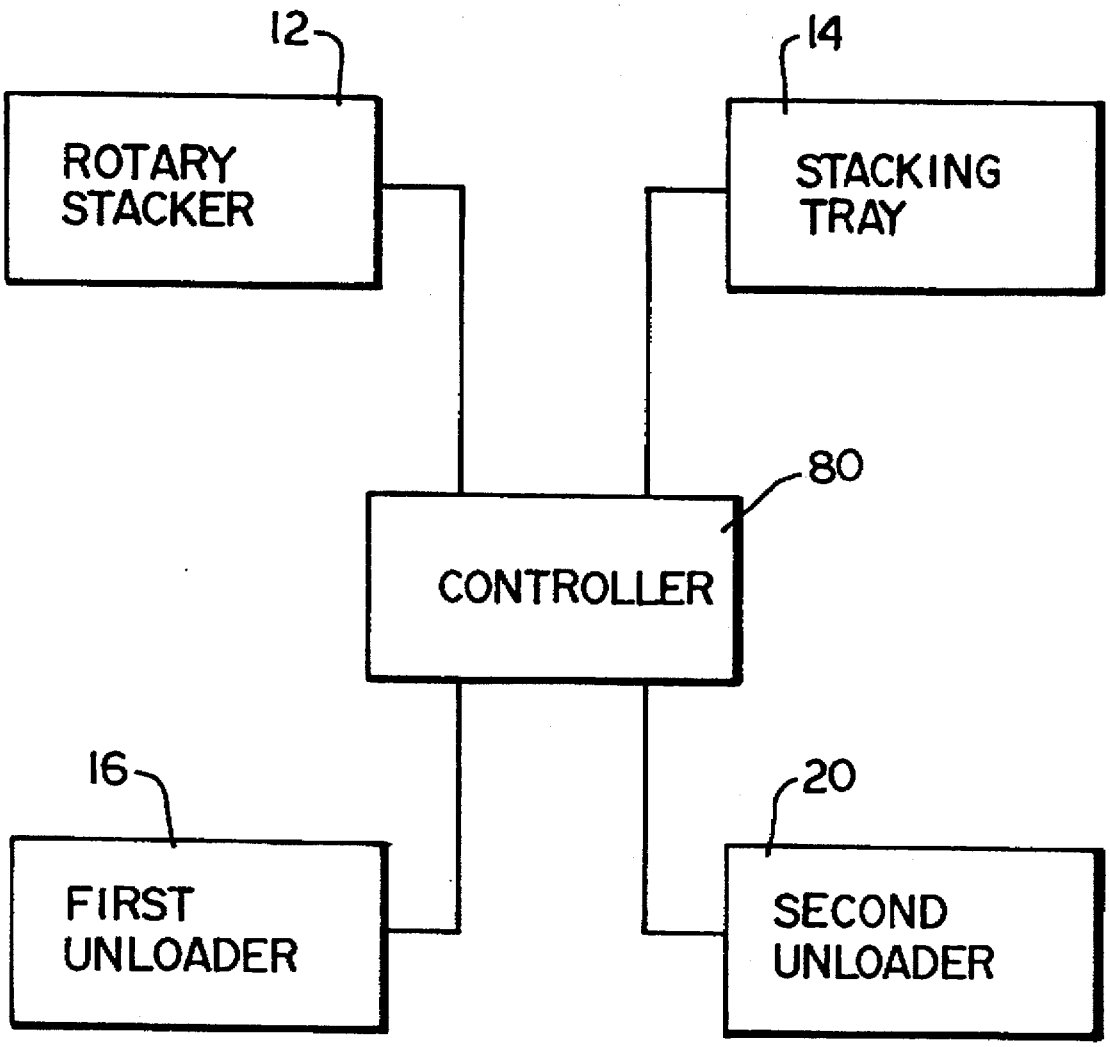
FIG. 4 is a schematic drawing showing the control system.

As best seen in FIG. 4, a controller 80 is connected to rotary stacker 12, stacking tray 14, and first and second unloaders 16 and 20. The controller 80 controls the operation of garment stacker 10 as described below.

In operation, garment stacker 10 stacks garments onto stacking tray 14 to form interlocking front and rear garment stacks F and R as schematically shown in FIG. 5 and 6. The garment transfer cycle shown in FIGS. 5A–5H transfers a garment G onto front garment stack F which is offset from a rear garment stack R located on stacking tray 14. The garment transfer cycle shown in FIGS. 6A–6H transfers a garment G onto rear garment stack R.

Figure 5A:
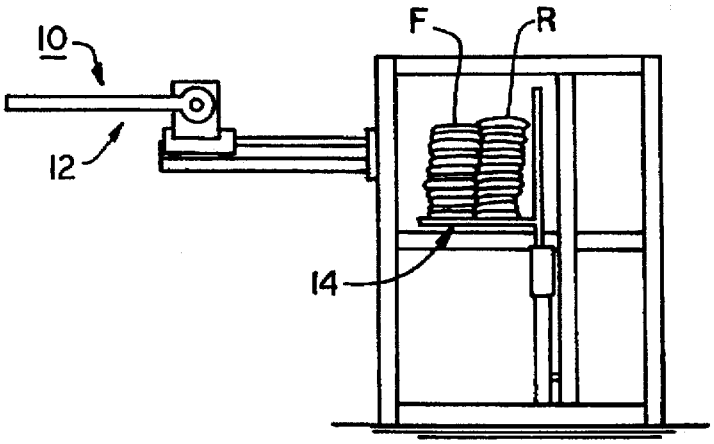
FIGS. 5A–5H are a sequence of schematic views showing the garment stacker loading a garment on a front garment stack.
Figure 5B:
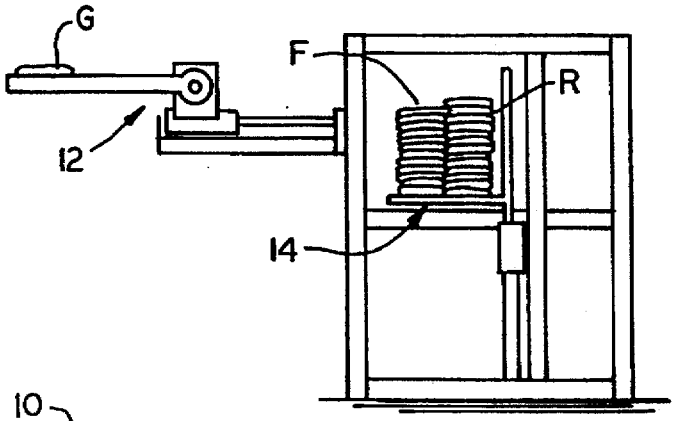

Referring to FIGS. 5A–5H, a garment transfer cycle for transferring a garment G to front garment stack F operates as follows. Rotary stacker 12 initially assumes a load position as shown in FIG. 5A. A garment is placed upon garment support arms 26 and 30 as shown in FIG. 5B, such that the garment extends across support surface 32 of support arms 26 and 30 and over vacuum openings 34. The vacuum actuator 36 creates a vacuum across vacuum openings 34 that causes the supported garment G to be gripped onto garment support arms 26 and 30.

Figure 5C:
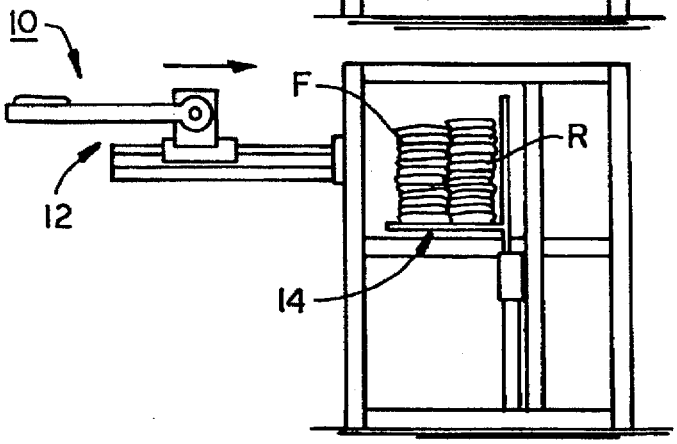
Figure 5D:
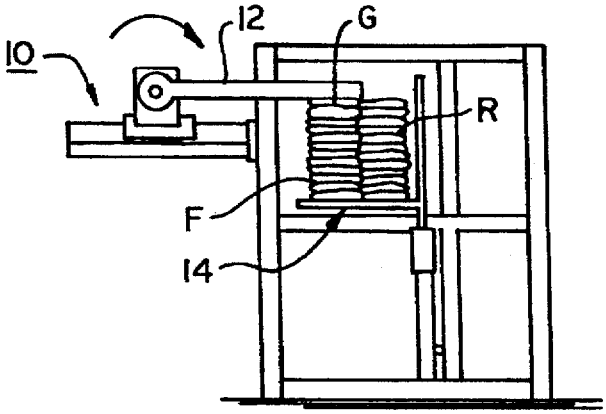

After garment G is gripped by garment support arms 26 and 30, slide assembly 46 positions carriage 50 and mounted rotary arm 42 from a retracted position to a partially-extended position located midway between stops 54 and 56 on frame 22, as shown in FIG. 5C. Positioning rotary arm 42 in the partially-extended position results in garment support arms 26 and 30 being positioned to transfer garment G to front garment stack F. As shown in FIG. 5D, rotary arm 42 and attached garment support arm 26,30 are then rotated 180° to an unloading position. The 180° rotation results in the support surface 32 of support arms 26 and 30 being positioned from an upright, horizontal position to a downright, horizontal position where the garment G is positioned on top of front garment stack F located on stacking tray 14.

Garment G is positioned on front garment stack F such that an end portion of garment G overlaps an end portion of the top garment on rear garment stack R. Loading garments in this overlapping manner results in the garments in the front and rear stacks F and R being interlocked with one another to form a stable bundle as shown in FIGS. 5A–5H.

Figure 5E:
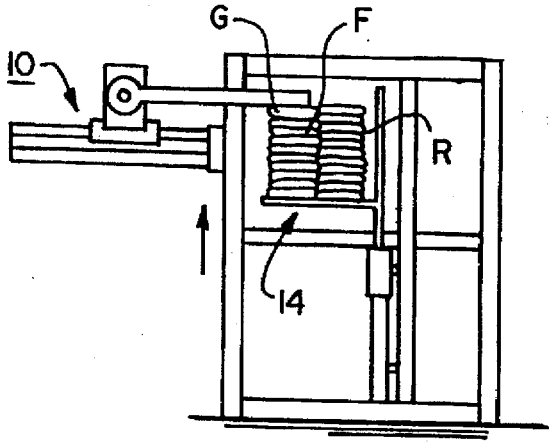
Figure 5F:
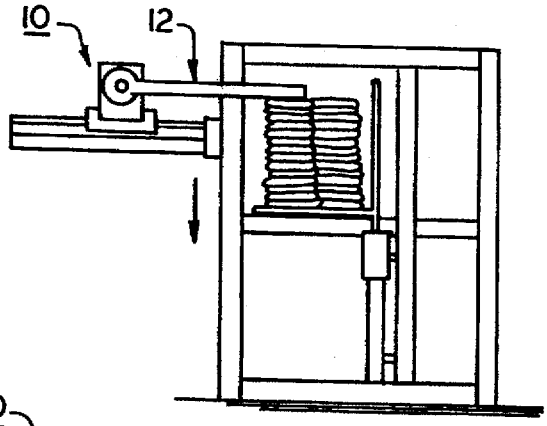

As shown in FIG. 5E, after garment G is placed on garment stack F, tray actuator 64 raises bottom tray 60 of stacking tray 14. As bottom tray 60 rises, garment stack F is pressed between bottom tray 60 and support surfaces 32 of support arms 26 and 30. A torque is placed on support arms 26 and 30 by the upward force created by tray actuator 64. Rotary motor 44 of rotary stacker 12 maintains support arms 26 and 30 in its unloading position where support surfaces 32 are in a generally horizontal position. In order to maintain the garment support arms in the unloading position, the rotary motor 44 must produce sufficient counter-torque to resist the upward force created by tray actuator 64. To create this additional counter-torque, an increased amount of current is supplied to rotary motor 44. Once a threshold torque has been reached, tray actuator 64 moves bottom tray 60 downward, as shown in FIG. 5F, for a selected period of time. The threshold torque at which tray actuator begins to lower bottom tray 60 is designed so that garment stack F is placed under sufficient pressure to insure effective stacking of the garments. In the preferred embodiment, the pounds of pressure placed on the stacked garments is between about 10 to 20 pounds.

The stacked garments are placed under the selected stacking pressure by controlling the torque placed on garment support arms 26 by stacking tray 14. In particular, increasing amounts of current are supplied to rotary motor 44 of rotary stacker 12 to maintain garment support arms 26 and 30 in their horizontal, downright position as bottom tray 60 moves upward. Controller 80 monitors the amount of current supplied to rotary motor 44 and signals tray actuator 64 to move bottom tray 60 downward when a predetermined amount of current being supplied to rotary motor 44 is detected. Tray 14 moves down for a preset time or distance and then the brake locks the tray in its vertical position.

At a time after garment G is placed on front garment stack F and prior to bottom tray 60 being lowered, vacuum actuator 36 releases the vacuum produced at vacuum openings 34 on garment support arms 26 and 30. The garment G is thus released from the garment support arms 26 and 30 and moved downwardly with bottom tray 60.

Figure 5G:
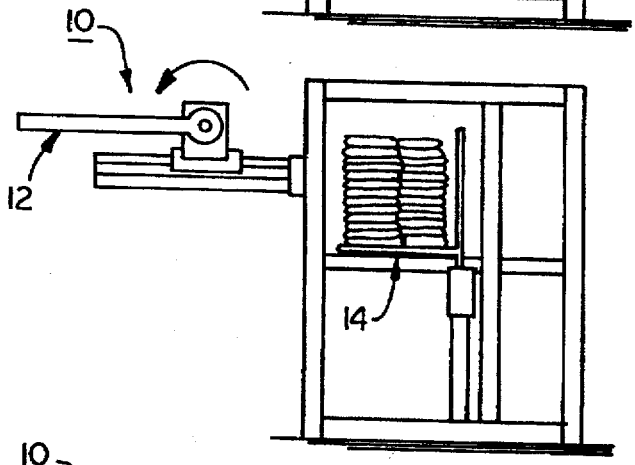
Figure 5H:
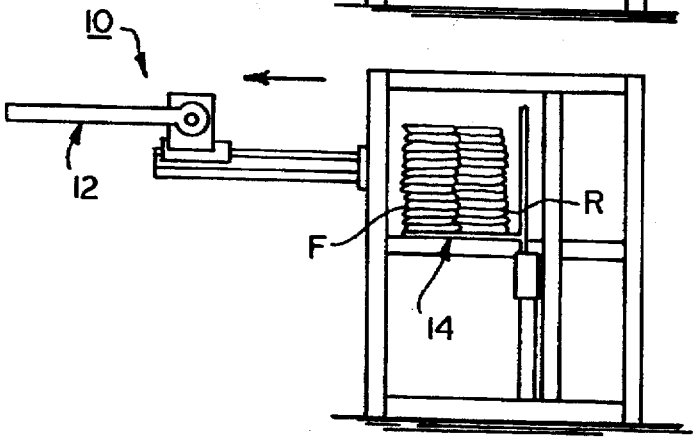

As shown in FIG. 5G, once bottom tray 60 has been lowered, garment support arms 26 and 30 are then rotated 180° to their loading position. Slide assembly 46 then retracts rotary arm 42 to its retracted position, as shown in FIG. 5H, such that support arms 26 are 30 are ready to receive another garment and perform the next garment transfer cycle.

Figure 6A:
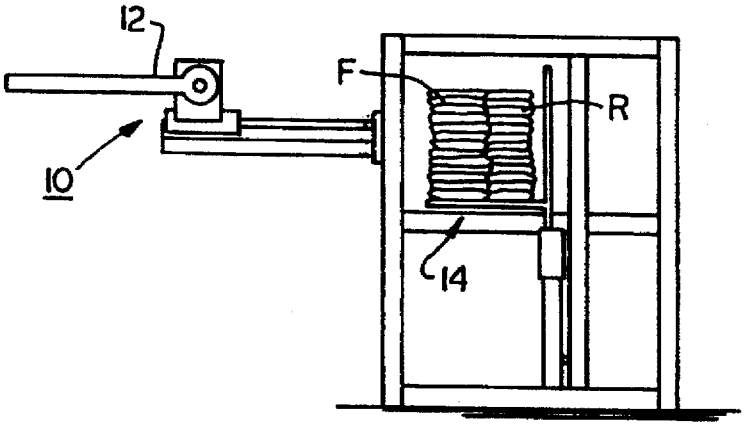
FIGS. 6A–6H are a sequence of schematic views showing the garment stacker loading a garment on a rear garment stack.
Figure 6B:
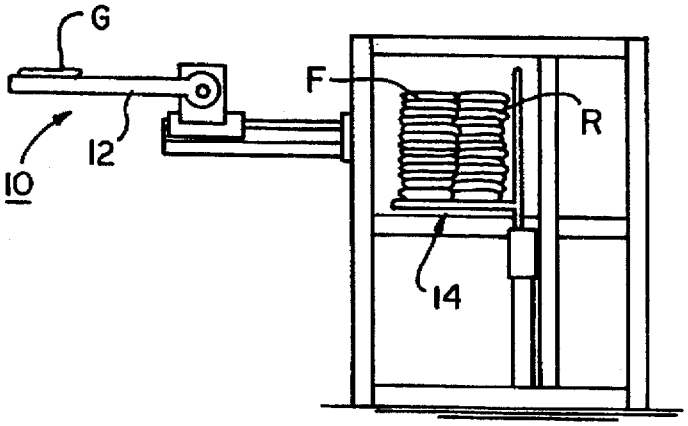
Figure 6C:
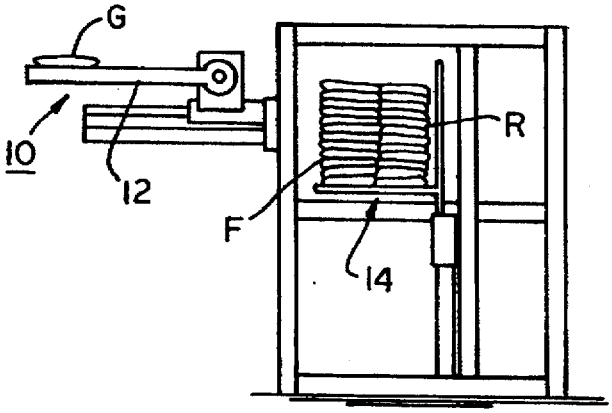
Figure 6D:
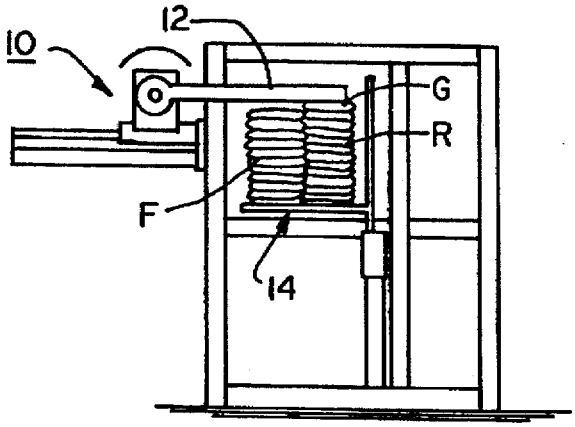
Figure 6E:
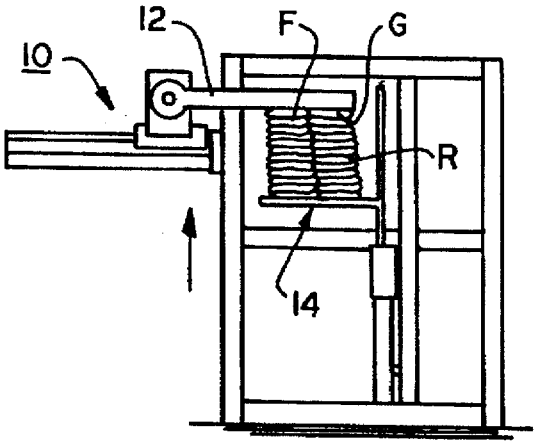
Figure 6F:
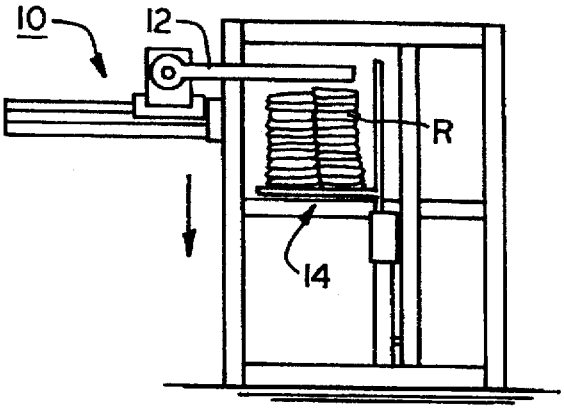
Figure 6G:
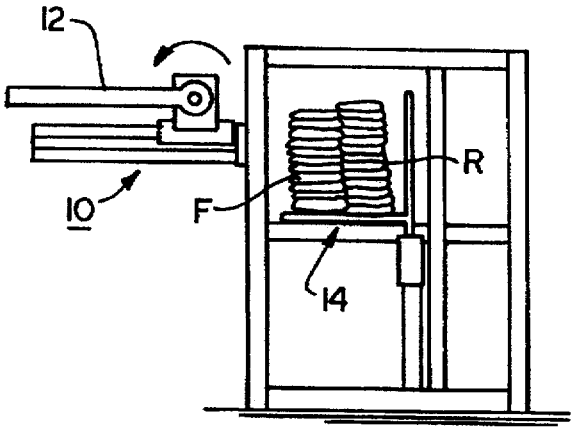
Figure 6H:
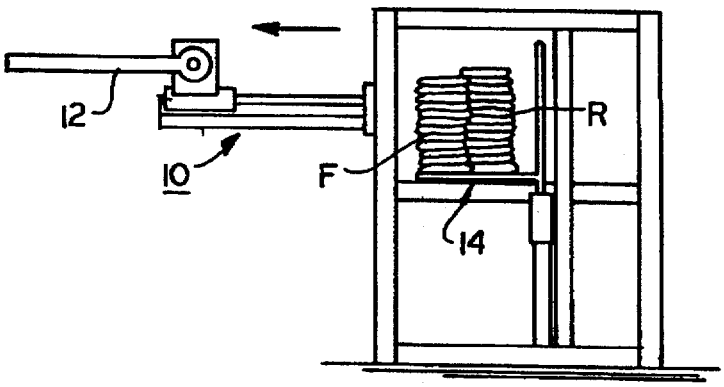

Referring to FIGS. 6A–6H, after loading a garment onto front garment stack F, a second garment transfer is performed to position a garment G onto rear garment stack R. The second garment transfer cycle is similar to the first garment transfer cycle described above with the exception that garment G is positioned on rear garment stack R. As shown in FIG. 6C, after loading, garment support arms 26 and 30 are transversely positioned by slide actuator 52 to a fully extended position. Rotating arm 42 and attached garment stacking arms 26 and 30 are positioned closer to stacking tray 14 when placed in the fully extended position such that the garment support arms 26 and 30 are rotatable to position garment 62 on rear garment stack R located on bottom tray 60.

Garment G is positioned on rear garment stack R such that an end portion of garment G overlaps an end portion of the top garment on front garment stack F. As discussed, loading garments in this overlapping manner results in the front and rear garment stacks being interlocked with one another to form a stable bundle.

As shown in FIGS. 6E–6H, after positioning garment G over rear garment stack R, the garment transfer cycle is completed in the same manner as described in FIG. 5A–5H.

The successive first and second garment transfer cycles are repeated so that garments are alternately placed on garment stacks F and R. This results in two adjacent stacks of garments being formed on the bottom tray 60 of stacking tray 14. The garments are alternately placed on the adjacent stacks such that two interlocked stacks of garments are formed. The controller 80 maintains a count on the number of garments placed on the stack and discontinues the garment transfer cycles after a selected number of garments have been stacked on stacking tray 14.

After the selected number of garments have been stacked on stacking tray 14, the controller 80 signals first unloader 16 to remove the stacked garments from stacking tray 14. First, tray 14 moves to its full down position. Then, plate actuator 70 moves upright plate 66 from its retracted position to its extended position. As upright plate 66 moves to the extended position, upright plate 66 moves across bottom tray 60 and pushes the stacked garments onto bin 72.

Second unloader 20 then moves the stacked garments to an awaiting conveyor (not shown) or other transport device (not shown). Specifically, the upright plate 74 of second unloader 20 moves from its retracted position to its extended position to move the stacked garments on bin 72 to the awaiting conveyor or other transport mechanism. After removal of the stacked garments, garment stacker 10 repeats its cycle.

The garment stacker 10 of the present invention provides for the effective stacking and transfer of garment stacks. Each garment loaded onto stacking tray 14 is pressed onto the garment stack to insure a better stacking of the garments. In addition, garment stacker 10 provides for the stacking of a plurality of interlocked garment stacks and for the effective transferring of the garment stacks.

Certain modifications and improvements will occur to those skilled in the art upon a reading of the foregoing description. By way of example, other types of actuators could be adapted for the present invention. It should be understood that all such modifications and improvements have been deleted herein for the sake of conciseness and readability but are properly within the scope of the following claims.

We claim:

1. A garment stacker for stacking garments in a garment stack, comprising:

(a) a stacking tray having a support tray for supporting garments placed thereon in a garment stack and a tray actuator for adjusting the position of said support tray;

(b) a rotary stacker positioned adjacent said stacking tray, wherein said rotary stacker repeatedly moves between a loading and an unloading position to successively stack garments on said stacking tray in a garment stack; and (c) a controller for directing said tray actuator to position said support tray upwards when said rotary stacker is in the unloading position so as to press said garment stack between said stacking tray and rotary stacker, wherein said controller directs said tray actuator to move upwardly until a selected threshold pressure is applied to said garment stack between said rotary stacker and stacking tray.

2. The apparatus according to claim 1, further including a first unloader for moving said garment stack from said stacking tray after a garment stack has been formed thereon, said first unloader including a first unloader plate positioned adjacent said support tray and a first unloader actuator for moving said first unloader plate from a retracted position to an extended position so as to move said first unloader plate over said support tray and push a garment stack therefrom.

3. The apparatus according to claim 2, further including a second unloader having a bin positioned to receive said garment stack moved from said support tray by said first unloader, said second unloader having a second unloading plate disposed in a generally transverse position with respect to said first plate and a second unloader actuator for moving said second unloading plate from a retracted position to an extended position so as to push said garment stack off said bin.

4. The apparatus according to claim 3, wherein said first unloader is moved from the retracted position to the extended position after a selected number of garments have been stacked on said stacker tray.

5. The apparatus according to claim 1, wherein said garment stack is pressed together after each garment is stacked on said support tray.

6. The apparatus according to claim 1, wherein said garment stack is placed under a predetermined pressure when pressed between said stacking tray and rotary stacker.

7. The apparatus according to claim 1, wherein the upward motion of said stacking tray is stopped in response to a predetermined current amount being supplied to said rotary stacker.

8. The apparatus according to claim 1, wherein said stacking tray further includes a back wall disposed generally perpendicular to said support tray.

9. A rotary stacker for a garment stacker having a stacking tray including a support tray for supporting garments placed thereon in a garment stack, comprising:

(a) a garment support for supporting a garment thereon; and (b) a rotary actuator for rotating said garment support between a loading position where said garment is placeable on and supportable by said garment support and an unloading position where said garment support and supported garment are positioned over said stacking tray, wherein said rotary stacker repeatedly moves between said loading and unloading positions to successively stack garments on said stacking tray in a garment stack and wherein said rotary stacker includes a rotary arm and a slide assembly for displacing said rotary arm between a spaced first position and second position and wherein said garment support positions a supported garment on a first section of said support tray when said rotary arm is in said first position and said garment support positions a supported garment on a second section of said support tray when said rotary arm is in said second positions.

10. The apparatus according to claim 9, wherein said garment support includes a gripper for selectively gripping said garment.

11. The apparatus according to claim 10, wherein said gripper is a pneumatic gripper.

12. The apparatus according to claim 1, wherein said first and second positions of said rotary arm are off-set a predetermined distance so that a garment placed on said support tray wherein said rotary arm is in said first position overlaps a garment placed on said support tray when said rotary arm is in said second position.

13. A garment stacker for stacking garments in a garment stack, comprising:

(a) a stacking tray having a support tray for supporting garments placed there on in a garment stack and a tray actuator for adjusting the position of said support tray;

(b) a rotary stacker positioned adjacent said stacking tray, wherein said rotary stacker repeatedly moves between a loading and an unloading position to successively stack garments on said stacking tray in a garment stack, said rotary stacker including: (i) a garment support for supporting a garment thereon; and (ii) a rotary actuator for rotating said garment support between said loading and unloading positions;

(c) a controller for directing said tray actuator to position said support tray upwards when said rotary stacker is in said unloading position so as to press said garment stack between said stacking tray and rotary stacker, wherein said controller directs said tray actuator to move upwardly until a selected threshold pressure is applied to said garment stack between said rotary stacker and stacking tray; and (d) a first unloader for moving said garment stack from said stacking tray after a garment stack has been formed thereon.

14. The apparatus according to claim 13, wherein said first unloader includes a first unloader plate positioned adjacent said support tray and a first unloader actuator for moving said first unloader plate from a retracted position to an extended position so as to move said first unloader plate over said support tray and push a garment stack thereform.

15. The apparatus according to claim 14, further including a second unloader having a bin positioned to receive said garment stack moved from said support tray by said first unloader, said second unloader having a second unloading plate disposed in a generally transverse position with respect to said first plate and a second unloader actuator for moving said second unloading plate from a retracted position to an extended position so as to push said garment stack off said bin.

16. The apparatus according to claim 15, wherein said first unloader is moved from the retracted position to the extended position after a selected number of garments have been stacked on said stacker tray.

17. The apparatus according to claim 13, wherein said rotary stacker further includes a rotary arm and a slide assembly for displacing said rotary arm between a spaced first position and second position and wherein said garment support positions a supported garment on a first section of said support tray when said rotary arm is in said first position and said garment support positions a supported garment on a second section of said support tray when said rotary arm is in said second position.

18. The apparatus according to claim 17, wherein said first and second positions of said rotary arm are off-set a predetermined distance so that a garment placed on said support tray when said rotary arm is in said first position overlaps a garment placed on said support tray when said rotary arm is in said second position.

19. The apparatus according to claim 13, wherein said garment support includes a gripper for selectively gripping said garment.

20. The apparatus according to claim 19, wherein said gripper is a pneumatic gripper.

21. The apparatus according to claim 13, wherein said garment stack is pressed together after each garment is stacked on said support tray.

22. The apparatus according to claim 13, wherein said garment stack is placed under a predetermined pressure when pressed between said stacking tray and rotary stacker.

23. The apparatus according to claim 13, wherein the upward motion of said stacking tray is stopped in response to a predetermined current amount being supplied to said rotary stacker.

24. The apparatus according to claim 13, wherein said stacking tray further includes a back wall disposed generally perpendicular to said support tray.

25. A method for stacking garments in a garment stack, said method comprising the steps of:

(a) supporting garments placed thereon a stacking tray having a support tray in a garment stack and adjusting the position of said support tray by a tray actuator;

(b) successively stacking garments on said stacking tray in a garment stack by a rotary stacker positioned adjacent said stacking tray, wherein said rotary stacker repeatedly moves between a loading and an unloading position; and (c) directing said tray actuator to position said support tray upwards when said rotary stacker is in the unloading position so as to press said garment stack between said stacking tray and rotary stacker by a controller, wherein said controller directs said tray actuator to move upwardly until a selected threshold pressure is applied to said garment stack between said rotary stacker and stacking tray.

26. A method for stacking garments in a garment stacker having a stacking tray including a support tray for supporting garments placed thereon in a garment stack, said method comprising the steps of:

(a) supporting a garment thereon a garment support; and (b) rotating said garment support between a loading position where said garment is placeable on and supportable by said garment support and an unloading position where said garment support and supported garment are positioned over said stacking tray by a rotary actuator, wherein said garment support repeatedly moves between said loading and unloading positions to successively stack garments on said stacking tray in a garment stack and wherein said rotary stacker includes a rotary arm and a slide assembly for displacing said rotary arm between a spaced first position and second position and wherein said garment support positions a supported garment on a first section of said support tray when said rotary arm is in said first position and said garment support positions a supported garment on a second section of said support tray when said rotary arm is in said second position.

27. A method for stacking garments in a garment stack, said method comprising the steps of:

(a) supporting garments placed thereon a stacking tray having a support tray in a garment stack and adjusting the position of said support tray by a tray actuator;

(b) repeatedly moving a rotary stacker positioned adjacent said stacking tray between a loading and an unloading position to successively stack garments on said stacking tray in a garment stack, said rotary stacker including: (i) a garment support for supporting a garment thereon; and (ii) a rotary actuator for rotating said garment support between said loading and unloading positions; and (c) directing said tray actuator to position said support tray upwards when said rotary stacker is in said unloading position so as to press said garment stack between said stacking tray and rotary stacker by a controller, wherein said controller directs said tray actuator to move upwardly until a selected threshold pressure is applied to said garment stack between said rotary stacker and stacking tray; and (d) moving said garment stack from said stacking tray after a garment stack has been formed thereon by a first unloader.

28. A method for stacking garments in a garment stack, said method comprising the steps of:

(a) supporting garments placed thereon a stacking tray having a support tray in a garment stack and adjusting the position of said support tray by a tray actuator;

(b) repeatedly moving a rotary stacker positioned adjacent said stacking tray between a loading and an unloading position to successively stack garments on said stacking tray in a garment stack, said rotary stacker including: (i) a garment support for supporting a garment thereon; and (ii) a rotary actuator for rotating said garment support between said loading and unloading positions and wherein said rotary stacker further includes a rotary arm and a slide assembly for displacing said rotary arm between a spaced first position and second position and wherein said garment support positions a supported garment on a first section of said support tray when said rotary arm is in said first position and said garment support positions a supported garment on a second section of said support tray when said rotary arm is in said second position; and (c) directing said tray actuator to position said support tray upwards when said rotary stacker is in said unloading position so as to press said garment stack between said stacking tray and rotary stacker by a controller; and (d) moving said garment stack from said stacking tray after a garment stack has been formed thereon by a first unloader.

29. A garment stacker for stacking garments in a garment stack, comprising:

(a) a stacking tray having a support tray for supporting garments placed thereon in a garment stack and a tray actuator for adjusting the position of said support p1(b) a rotary stacker positioned adjacent said stacking tray, wherein said rotary stacker repeatedly moves between a loading and an unloading position to successively stack garments on said stacking tray in a garment stack, said rotary stacker including: (i) a garment support for supporting a garment thereon; and (ii) a rotary actuator for rotating said garment support between said loading and unloading positions and wherein said rotary stacker further includes a rotary arm and a slide assembly for displacing said rotary arm between a spaced first position and second position and wherein said garment support positions a supported garment on a first section of said support tray when said rotary arm is in said first position and said garment support positions a supported garment on a second section of said support tray when said rotary arm is in said second position;

(c) a controller for directing said tray actuator to position said support tray upwards when said rotary stacker is in said unloading position so as to press said garment stack between said stacking tray and rotary stacker; and (d) a first unloader for moving said garment stack from said stacking tray after a garment stack has been formed thereon.

30. The apparatus according to claim 29, wherein said first unloader includes a first unloader plate positioned adjacent said support tray and a first unloader actuator for moving said first unloader plate from a retracted position to an extended position so as to move said first unloader plate over said support tray and push a garment stack therefrom.

31. The apparatus according to claim 30, further including a second unloader having a bin positioned to receive said garment stack moved from said support tray by said first unloader, said second unloader having a second unloading plate disposed in a generally transverse position with respect to said first plate and a second unloader actuator for moving said second unloading plate from a retracted position to an extended position so as to push said garment stack off said bin.

32. The apparatus according to claim 31, wherein said first unloader is moved from the retracted position to the extended position after a selected number of garments have been stacked on said stacker tray.

33. The apparatus according to claim 29, wherein said garment support includes a gripper for selectively gripping said garment.

34. The apparatus according to claim 33, wherein said gripper is a pneumatic gripper.

35. The apparatus according to claim 29, wherein said garment stack is pressed together after each garment is stacked on said support tray.

36. The apparatus according to claim 29, wherein said garment stack is placed under a predetermined pressure when pressed between said stacking tray and rotary stacker.

37. The apparatus according to claim 29, wherein said controller directs said tray actuator to move upwardly until a selected threshold pressure is applied to said garment stack between said rotary stacker and stacking tray.

38. The apparatus according to claim 37, wherein the upward motion of said stacking tray is stopped in response to a predetermined current amount being supplied to said rotary stacker.

39. The apparatus according to claim 29, wherein said stacking tray further includes a back wall disposed generally perpendicular to said support tray.

40. The apparatus according to claim 29, wherein said first and second positions of said rotary arm are off-set a predetermined distance so that a garment placed on said support tray when said rotary arm is in said first position overlaps a garment placed on said support tray when said rotary arm is in said second position.

* * * * *